US009302293B2

(12) United States Patent
Schneider

(10) Patent No.: US 9,302,293 B2
(45) Date of Patent: Apr. 5, 2016

(54) DEDUSTING APPARATUS HAVING DUAL WASH DECKS WITH INDIVIDUALLY ADJUSTABLE PRODUCT FLOW REGULATION

(71) Applicant: Pelletron Corporation, Lancaster, PA (US)

(72) Inventor: Heinz Schneider, Lancaster, PA (US)

(73) Assignee: Pelletron Corporation, Lancaster, PA (US)

( * ) Notice: Subject to any disclaimer, the term of this patent is extended or adjusted under 35 U.S.C. 154(b) by 156 days.

(21) Appl. No.: 14/189,399

(22) Filed: Feb. 25, 2014

(65) Prior Publication Data

US 2014/0174993 A1 Jun. 26, 2014

Related U.S. Application Data

(63) Continuation-in-part of application No. 13/474,010, filed on May 17, 2012, now Pat. No. 8,833,563, and a continuation-in-part of application No. 13/041,678, filed on Mar. 7, 2011, now Pat. No. 8,931,641.

(60) Provisional application No. 61/319,251, filed on Mar. 30, 2010, provisional application No. 61/489,460, filed on May 24, 2011.

(51) Int. Cl.

| | |
|---|---|
| ***B07B 4/00*** | (2006.01) |
| ***B07B 4/08*** | (2006.01) |
| ***B07B 7/04*** | (2006.01) |
| ***B07B 4/02*** | (2006.01) |

(52) U.S. Cl.
CPC ... *B07B 4/08* (2013.01); *B07B 4/02* (2013.01); *B07B 7/04* (2013.01)

(58) Field of Classification Search
CPC ..... B07B 4/00; B07B 4/02; B07B 4/08; B07B 7/00; B07B 7/04; B07B 7/06
USPC ..... 209/39, 137, 145, 149, 133, 136, 209/138–141
See application file for complete search history.

(56) References Cited

U.S. PATENT DOCUMENTS

| | | | |
|---|---|---|---|
| 5,035,331 | A | 7/1991 | Paulson |
| 6,595,369 | B2 | 7/2003 | Paulson |
| 7,380,670 | B2 | 6/2008 | Paulson et al. |
| 8,016,116 | B2 | 9/2011 | Schneider |

*Primary Examiner* — Joseph C Rodriguez
*Assistant Examiner* — Kalyanavenkateshware Kumar
(74) *Attorney, Agent, or Firm* — Miller Law Group, PLLC

(57) ABSTRACT

A dedusting apparatus is formed with a rectangular inlet structure that assures a fully loaded feeding of particulate material over the face of the opposing wash decks. A rectangular inlet box having substantially the same width dimension as the corresponding dimension of the adjacent wash decks provides an even distribution of particulate material over the entire surface of the wash decks. A reconfiguration of the air inlet structure eliminates a rearward air plenum and manifold by passing the air flow upwardly through the bottom wall of the apparatus housing, rather than through the rear wall. Individually adjustable inlet deflectors can regulate the product flow on each respective wash deck and can be closed to stop the product flow completely to either one or both of the wash decks. Actuators control the movement of the deflectors, which can be integrated in an overall electronic control system for the dedusting apparatus.

21 Claims, 16 Drawing Sheets

DEDUSTING APPARATUS HAVING DUAL WASH DECKS WITH INDIVIDUALLY ADJUSTABLE PRODUCT FLOW REGULATION

CROSS-REFERENCE TO RELATED APPLICATIONS

This application is a continuation-in-part of U.S. patent application Ser. No. 13/474,010, filed on May 17, 2012, and granted as U.S. Pat. No. 8,833,563 on Sep. 16, 2014, which is a continuation-in-part of U.S. patent application Ser. No. 13/041,678, filed on Mar. 7, 2011, and granted as U.S. Pat. No. 8,931,641 on Jan. 15, 2015, and claims domestic priority on U.S. Provisional Patent Application Ser. No. 61/319,251, filed Mar. 30, 2010, and on U.S. Provisional Patent Application Ser. No. 61/489,460, filed on May 24, 2011, the contents of which are incorporated herein by reference.

FIELD OF THE INVENTION

The invention disclosed in this application is directed generally to an apparatus for the cleaning and handling of particulate materials, such as plastic pellets, grains, glass, and the like, and particularly to the a dedusting apparatus that can be utilized with product feed conduits extending at an angle to vertical.

BACKGROUND OF THE INVENTION

It is well known, particularly in the field of transporting and using particulate materials, commonly powders, granules, pellets, and the like, that it is important to keep product particles as free as possible of contaminants. Particulates are usually transported within a facility where they are to be mixed, packaged or used in a pressurized tubular system that in reality produces a stream of material that behaves somewhat like a fluid. As these materials move through the pipes, considerable friction is generated not only among the particles themselves, but also between the tube walls and the particles in the stream. In turn, this friction results in the development of particle dust, broken particles, fluff, streamers (ribbon-like elements that can "grow" into quite long and tangled), glass fibers in glass filled products, that can impede the flow of materials. The characteristics of such a transport system are quite well known, as is the importance and value of keeping product particles as free as possible of contaminants.

The term "contaminant" as used herein includes a broad range of foreign material and includes foreign material as well as broken particles or streamers of the product being transported. The generation of contaminants, also referred to as dust, including microdust, can be from a large number of sources, including, in the way of examples, the creation of dust particles during the processing of plastic pellets in which the larger particles are segregated to be re-ground; organic matter in food grains, such as shells and hulls; the creation of dust in the formation of iron ore pellets; and, as noted previously, the mere conveyance of the pellets in pipes and other mechanical conveying and handling systems. Using plastics as an example, such foreign material could have a detrimental effect on the finished product. Specifically, foreign material different in composition from the primary material, such as dust, and non uniform material of the primary product, such as streamers, would not necessarily have the same melting temperatures as the primary product and would cause flaws when the plastics material is melted and molded. Furthermore, streamers can impact the weighing scale and plug the dosing screws at bagging stations.

Considering product quality, and focusing on moldable plastics as a primary example, foreign material different in composition from the primary material, such as dust, non-uniform material of the primary product, fluff, and streamers, does not necessarily have the same melting temperatures as the primary product and causes flaws when the material is melted and molded. These flaws result in finished products that are not uniform in color, may contain bubbles, and often appear to be blemished or stained, and are, therefore, unsellable. It is important to note that since these same non-uniform materials often do not melt at the same temperature as the primary product, the unmelted contaminants cause friction and premature wear to the molding machines, resulting in downtime, lost production, reduced productivity, increased maintenance and thus increased overall production costs.

Since dust and other contaminants are generated mostly by the transport system, it is of primary importance to not only provide apparatus for thoroughly cleaning the particles, but to do so as close to the point of use of the particles as possible so as to avoid the generation of contaminants through additional transport. Accordingly, compact dedusters have been used for many years to clean materials in this application, capable of handling smaller volumes of product, yet also capable of thoroughly cleaning the product. The compact dedusters permit the installation of the deduster immediately before final use of the products, such as being installed directly on top of molding machines or extruders, or on top of silos, as well as under silos, before packaging and bagging, rather than at an earlier stage after which re-contamination can occur before the products are utilized. Of course, the dedusters can be installed as a free standing unit, as well.

Dedusters used to clean contaminants from particulate material can be found in U.S. Pat. No. 5,035,331, granted to Jerome I. Paulson on Jul. 30, 1991, in which air is blown upwardly through wash decks over which a flow of contaminated particulate material is passed so that the flow of air up through the wash decks removes the contaminants from the material flow. A magnetic field is provided by the deduster so that the particulate material flow passes through the magnetic field to neutralize the static charge on the particulates and facilitate the removal of the contaminants from the material. The flow of contaminant laden air is discharged from the deduster, while the cleaned particulate material is passed on to the manufacturing process.

A compact dedusting apparatus is disclosed in U.S. Pat. No. 6,595,369, granted on Jul. 22, 2003, to Jerome I. Paulson. Like the larger dedusting apparatus depicted in U.S. Pat. No. 5,035,331, the follow of particulate material is cleansed of contaminates that have had the static charged attracting the contaminates to the particulates neutralized. The cleaning process utilizes a flow of air passing through the stream of particulate material passing over wash decks. The contaminate-laden air is discharged through the top of the dedusting apparatus, while the cleaned particulate material is discharged from the bottom of the deduster.

In U.S. Pat. No. 7,380,670, granted on Jun. 3, 2008, to Jerome I. Paulson, et al, and in U.S. Pat. No. 8,016,116, granted on Sep. 13, 2011, to Heinz Schneider, the dedusting apparatus includes a pair of oppositely directed wash decks receiving contaminated particulate material from a common infeed port. The infeed mechanism divides the material flow between the two opposing wash decks and directs the particulate material over a flow of air passing through the first wash decks, then through laterally spaced Venturi zones and onto inwardly directed secondary wash decks that direct the cleaned particulate material into a central discharge opening. Air flow to the primary and secondary wash decks is directed through a rearwardly located manifold that has a central primary opening and laterally spaced lower openings below the secondary wash decks.

These compact dedusters are provided with single and double (back-to-back) wash decks and are utilized with a vertically oriented conduit in which particulate material is conveyed to the manufacturing apparatus utilizing the particulate material. Accordingly, the product inlet opening at the top of the dedusting apparatus is in vertical alignment with the cleaned product outlet opening. The particulate material is introduced into the inlet opening and is metered onto a diagonally oriented primary wash deck through which air is blown from an air supply inlet to clean dust and debris from the particulate material flowing over the wash deck. In these dedusting devices, the particulate material is discharged off the lower end of the wash deck and falls through a Venturi zone in which air is moving upwardly to provide a vigorous cleaning action to the particulate material. The material falling through the Venturi zone is received on a secondary wash deck that is oriented oppositely of the primary wash deck to direct material back to the centrally aligned cleaned product outlet opening.

Further, with a single inlet and a single outlet, the conventional dedusting apparatus is limited in operation to being utilized to feed a single receiver of the cleaned particulate material passing through the dedusting apparatus. As is noted above, the discharge from the dedusting apparatus is typically used to load railroad cars or trucks, or to be received in a collection bag. With a single discharge outlet in the dedusting apparatus, the receiver can only be one of these conventional devices.

Dual outlet dedusting devices have been used to fill railroad cars with particulate material, such as plastic pellets, for bulk shipping to processing plants. Equal distribution of the particulate material to be cleaned on the wash decks is necessary so that the discharges through the opposing outlet ports will be substantially equal to balance the loading of the railroad cars. With round inlet ports, an equal distribution of the particulate material to be cleaned has been difficult to maintain as the particulate material is not always fed into the inlet port in a balanced distribution. Furthermore, a configuration of the air inlet into the dedusting apparatus would create an apparatus that has less structure to enhance the deployment of the dedusting apparatus.

With increasing capacity of the dedusting apparatus, it would be advantageous to provide for a fully balanced distribution of the inflow of particulate material to be cleaned over the opposing wash decks of the dedusting apparatus, while re-configuring the structure for delivery of the air into the dedusting apparatus would create a cleaner housing to enhance the deployment of the dedusting apparatus in high capacity situations.

SUMMARY OF THE INVENTION

It is an object of this invention to overcome the disadvantages of the prior art by providing an apparatus for removing dust and debris from particulate material having an inlet structure that will provide a balanced flow of particulate material over the opposing wash decks for the cleaning of the particulate material.

It is another object of this invention to provide a dedusting apparatus with a rectangular inlet port.

It is an advantage of this invention that the discharge of cleaned particulate material through opposing discharge outlets would be substantially equal.

It is a feature of this invention that the dedusting apparatus establishes a fully loaded inlet structure to provide a balanced distribution of the particulate material over the opposing wash decks.

It is another feature of this invention that the rectangular inlet port is utilized to collect a supply of particulate material within the rectangular inlet port before the particulate material is released to flow over the opposing wash decks in a balanced, equally distributed manner.

It is another advantage of this invention that the rectangular inlet structure has a width dimension that is substantially equal to the corresponding width dimension of the opposing wash decks so that the wash decks remain fully utilized during operation.

It is still another feature of this invention that the rectangular inlet structure includes an opposing pair of adjustable flow limiting panels that is operable to prevent passage of particulate material over the opposing wash decks.

It is still another advantage of this invention that the opposing flow limiting panels are also operable to restrict the volume of particulate material flow over the surface of the opposing wash decks.

It is yet another feature of this invention that the flow limiting panels are positionally adjustable relative to the corresponding wash decks to vary the flow rate of particulate material over the wash decks.

It is still another object of this invention that the inlet air is delivered into the housing of the dedusting apparatus from vertically underneath the inlet port.

It is another feature of this invention that the air manifold directs air upwardly through the bottom of the dedusting apparatus housing and then underneath the opposing wash decks to pass through openings in the wash decks to clean the particulate material passing over the surface of the wash decks.

It is still another feature of this invention that ducts are provided around the housing of the dedusting apparatus to provide a supplemental flow of air into the Venturi zones at the discharge edge of each of the wash decks.

It is another advantage of this invention that the supplement air flow ducts receive a flow of air through openings in the back wall of the housing of the dedusting apparatus.

It is a further feature of this invention that the air flow through the dedusting apparatus follows a path through the bottom wall of the apparatus housing, then upwardly through the opposing wash decks to remove dirt and debris from the particulate material being passed over the surface of the wash decks, and then upwardly through the dirty air discharge ports on opposite sides of the central rectangular inlet structure.

It is still another advantage of this invention that the delivery of the clean air flow upwardly through the bottom of the apparatus housing allows the clean air plenum of the known prior art structures to be eliminated.

It is yet another advantage of this invention that the delivery of the clean air upwardly through the bottom of the apparatus housing results in a sleeker design appearance for the apparatus housing and enhances the deployment of the dedusting apparatus.

It is a further advantage of this invention that the housing defines a pair of discharge ports that are offset relative to the rectangular inlet opening structure through which the contaminated particulate material is directed into the dedusting apparatus.

It is still another object of this invention to support each wash deck with a support member that angles inwardly from the discharge edge of the wash deck to the floor of the housing.

It is yet another feature of this invention that the support member is formed with slotted openings to direct a flow of air from the air manifold through the support member and into the Venturi zone.

It is a further feature of this invention that the smallest horizontal dimension for the Venturi zone is located at the discharge edge of the each respective wash deck.

It is still another object of this invention to provide an independent control of the flow of particulate material over each of the two opposing wash decks in the dedusting apparatus.

It is still a further feature of this invention that the inlet deflectors are individually adjustable to regulate the flow of particulate material over the upper surface of each respective wash deck.

It is still a further advantage of this invention that the individually adjustable inlet deflectors are operable to close the operation of one of the wash decks independently of the opposing wash deck.

It is yet a further advantage of this invention that the controls provided through the individually adjustable inlet deflectors eliminates the need to provide a rotary valve in conjunction with the feeding of particulate material into a dedusting apparatus.

It is further object of this invention to provide a rectangular inlet structure for a dual discharge outlet dedusting apparatus, which is durable in construction, inexpensive of manufacture, carefree of maintenance, facile in assemblage, and simple and effective in use.

These and other objects features and advantages are accomplished according to the instant invention by providing a dedusting apparatus is formed with a rectangular inlet structure that assures a fully loaded feeding of particulate material over the face of the opposing wash decks. A rectangular inlet box having substantially the same width dimension as the corresponding dimension of the adjacent wash decks provides an even distribution of particulate material over the entire surface of the wash decks. A reconfiguration of the air inlet structure eliminates a rearward air plenum and manifold by passing the air flow upwardly through the bottom wall of the apparatus housing, rather than through the rear wall. Individual adjustable inlet deflectors that can regulate the product flow on each wash deck and can be closed to stop the product flow completely to either one or both of the wash decks. Actuators control the movement of the deflectors, which can be integrated in an overall electronic control system for the dedusting apparatus.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figure 1:
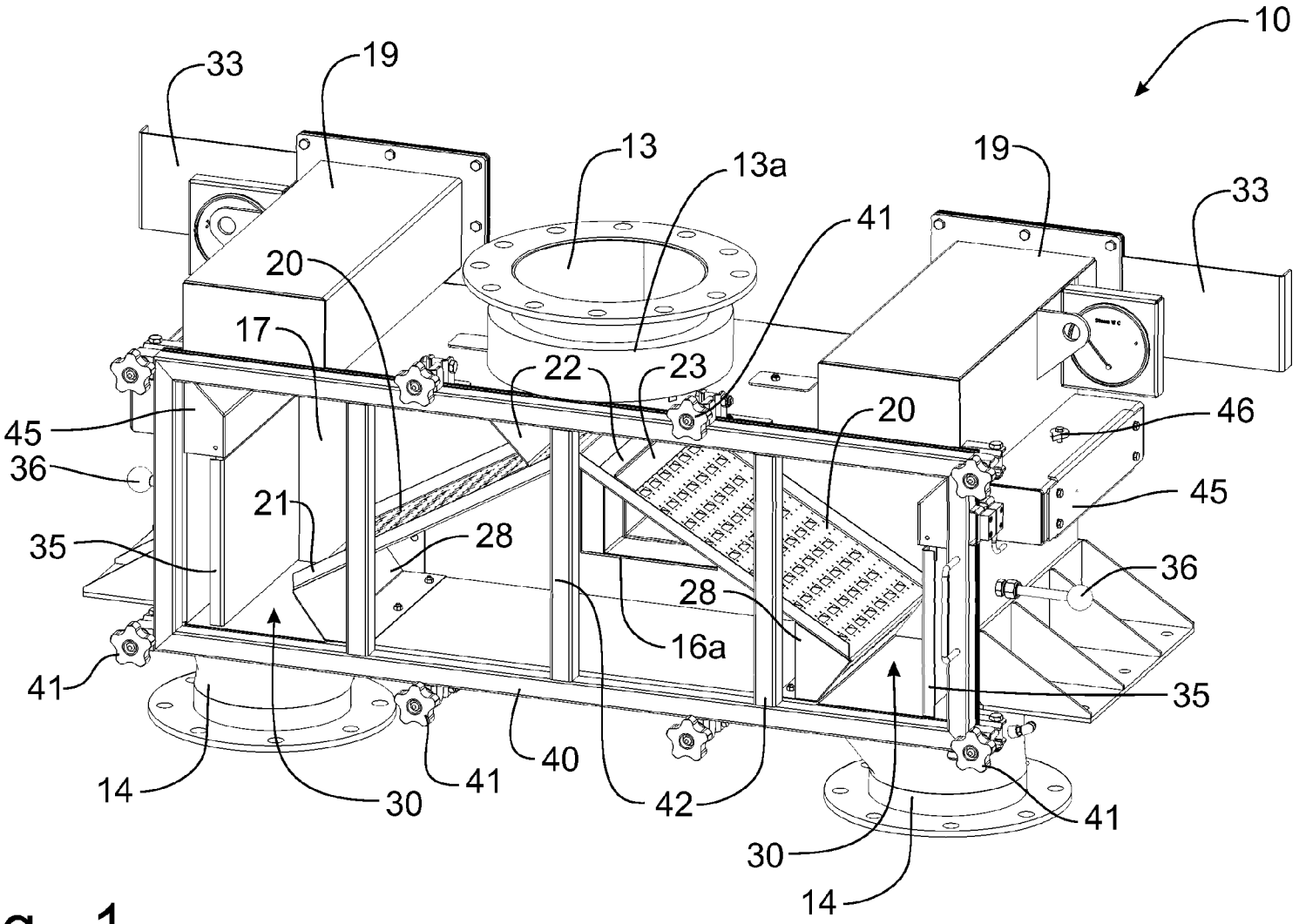
FIG. 1 is a schematic front perspective view of a dedusting apparatus incorporating the principles of the instant invention.

The dedusting apparatus is known in the art. A general description of the structure and operation of a conventional dedusting apparatus and a conventional compact dedusting apparatus can be found in U.S. Pat. No. 5,035,331 and in U.S. Pat. No. 6,595,369, both of which were issued to Jerome I. Paulson, the contents of each of these patents being incorporated herein by reference. Typical particulate material to be cleaned by the dedusting apparatus 10 is plastic pellets that are to be passed into an injection molding machine to form plastic components. Examples of plastic particulate material that can be cleaned of contaminate material by the dedusting apparatus 10 are polyester, acrylic, high density polyethylene, polypropylene, nylon, polycarbonates, styrene, and low density polyethylene. Any type of granular dry bulk materials such as minerals, foods, pharmaceuticals and others can be cleaned in the dedusting apparatus 10.

Referring to FIGS. 1-9, the dedusting apparatus 10, incorporating the principles of the instant invention, defines a central product inlet port 13 that is typically connected to a vertical portion of a fluent material handling system (not shown) such that the particulate material is fed into a product inlet port 13 located at the transverse center at the top of a generally airtight main housing 11. The main housing 11 has supports a pair of oppositely directed wash decks 20 that receive particulate material to be cleaned from the inlet port 13, as will be described in greater detail below. The main housing also defines an air inlet passageway 15 having an air inlet port 16 in the rear wall 12 of the main housing 11. As will be described in greater detail below, the introduction of an air flow through the air inlet port 16 will direct air through the wash decks to clean the particulate material.

The product inlet port 13 directs product particulates onto the wash decks 20 for cleaning. A magnetic coil 13*a* generates a magnetic flux field and is mounted at the inlet port 13 so that the flow of particulate material into the main housing 11 to be cleaned is subjected to the magnetic flux field to neutralize the static charges on the particulate pellets, thus making the separation of the contaminates, particularly microdust, from the pellets easier to accomplish. Air is fed into the housing 11 through the clean air inlet port 16 through the rear wall 12 to direct a flow of clean air into the housing 11, as will be described in greater detail below. A portion of the clean air passing through the inlet opening 16 is directed upwardly through the wash decks 20, while a remaining portion of the clean air flowing into the housing 11 is distributed to the Venturi zones 30, as will be described in greater detail below. One skilled in the art will recognize that baffles (not shown) may have to be provided to accomplish the desired division of the clean air flow between the wash decks 20 and the Venturi zones 30.

The wash decks 20 are supported by the housing 11 to present a downwardly sloping surface in opposite directions from the product inlet port 13 to the transversely spaced product outlet ports 14 over which the product to be cleaned, in the form of particulate particles, moves by gravity. An inlet deflector 22 is mounted to the housing 11 in a manner as to be slidable along the top surface of the housing 11 for directing the product particulates onto the wash deck 20. The inlet deflector 22 includes a trailing leg 23 that is oriented generally parallel to the slope of the wash deck 20 to force the product particulates into a laminar flow downwardly over the surface of the wash deck 20 toward the outlet port 14. The sliding movement of the inlet deflector 22 can be effected by manipulation of the adjustment pins 22*a* projecting through the housing 11 to allow adjustment of the depth of the laminar flow by positionally moving the inlet deflector 22 to the desired position.

The wash deck 20 is formed as a sloped tray having a top surface 24 in which are formed generally horizontal slots 25 and circular openings. The horizontal slots 25 are formed in conjunction with an upwardly extending deflector that presents a ramp to the product particulates moving downwardly over the top surface 24 of the wash deck 20. The slot 25 is formed as the horizontal opening across the top surface 24 between the deflector and the top surface 24, such that the air flowing through the slot 25 is directed by the deflector into the product in a generally horizontal direction, which is slightly upwardly with respect to the slope of the top surface 24 of the wash deck 20. Air moving through the circular openings is directed generally perpendicularly to the sloped top surface 24 of the wash deck 20. The net operative result is that the product particulates are subjected to a downward acceleration along the surface of the wash deck and to a turbulence generated by the movement of the particulates over the deflectors and by the substantially perpendicular air flow streams emanating from the circular openings and the horizontal slots 25. Accordingly, dust and debris contaminates are released from the product particulates and are carried by the air flow to the dirty air exhaust port 19 at the top of the housing 11.

Figure 10:
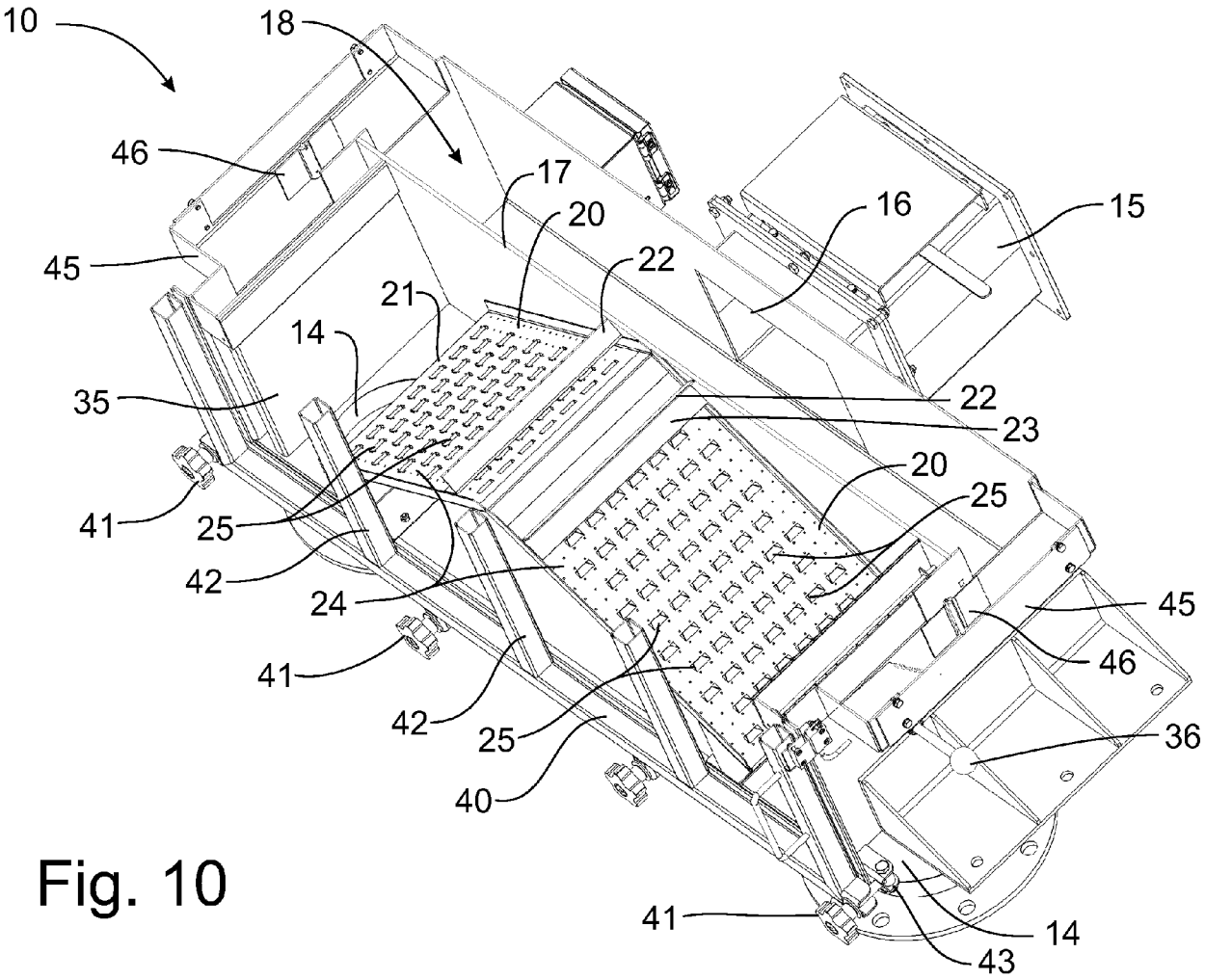
FIG. 10 is cross-sectional view of the main housing taken along lines 10-10 in FIG. 4 to show the clean air plenum.
Figure 11:
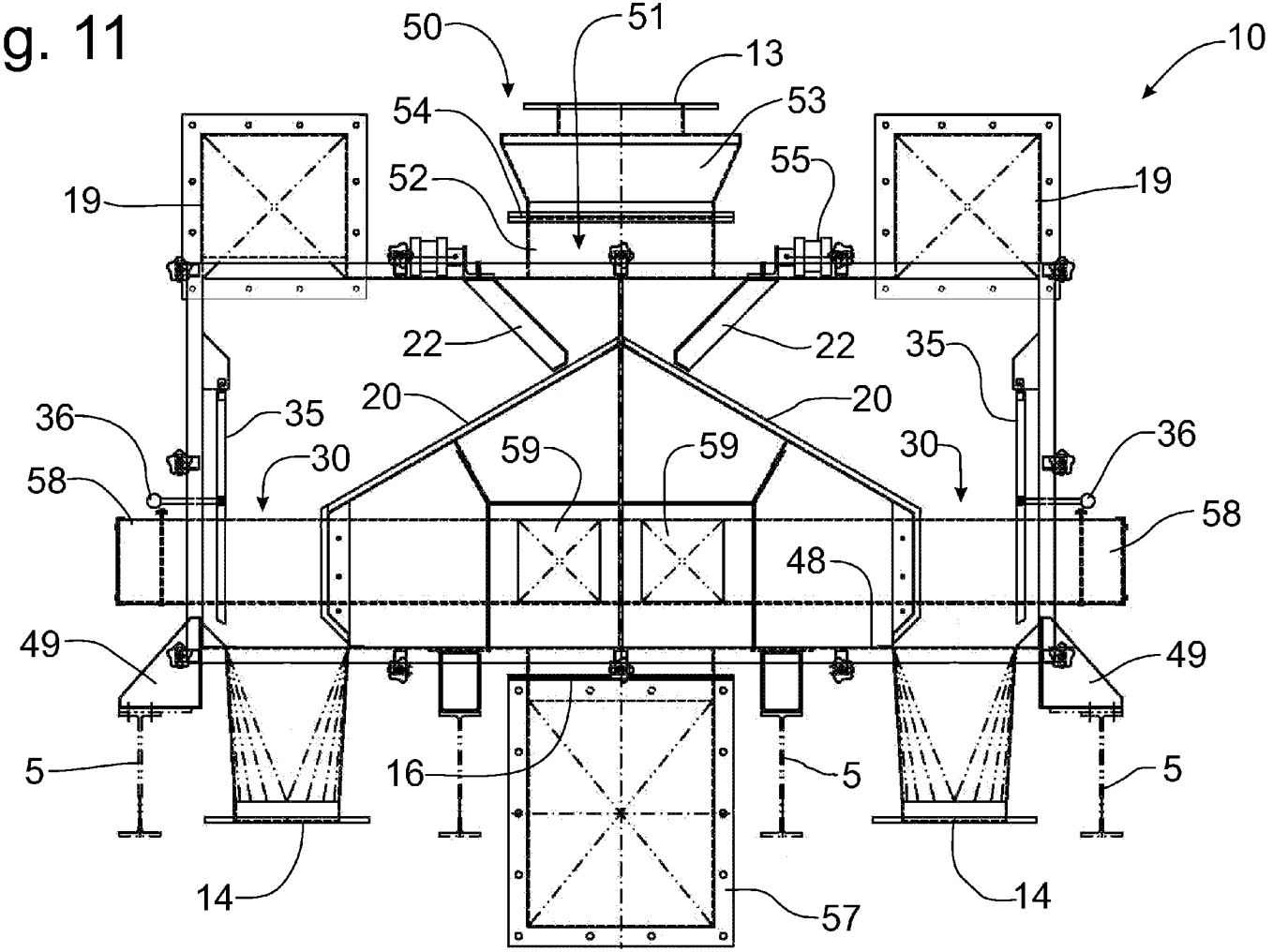
FIG. 11 is a front elevational view of another embodiment of a dedusting apparatus incorporating the principles of the instant invention, including a rectangular product inlet structure that establishes fully loaded opposing wash decks.
Figure 12:
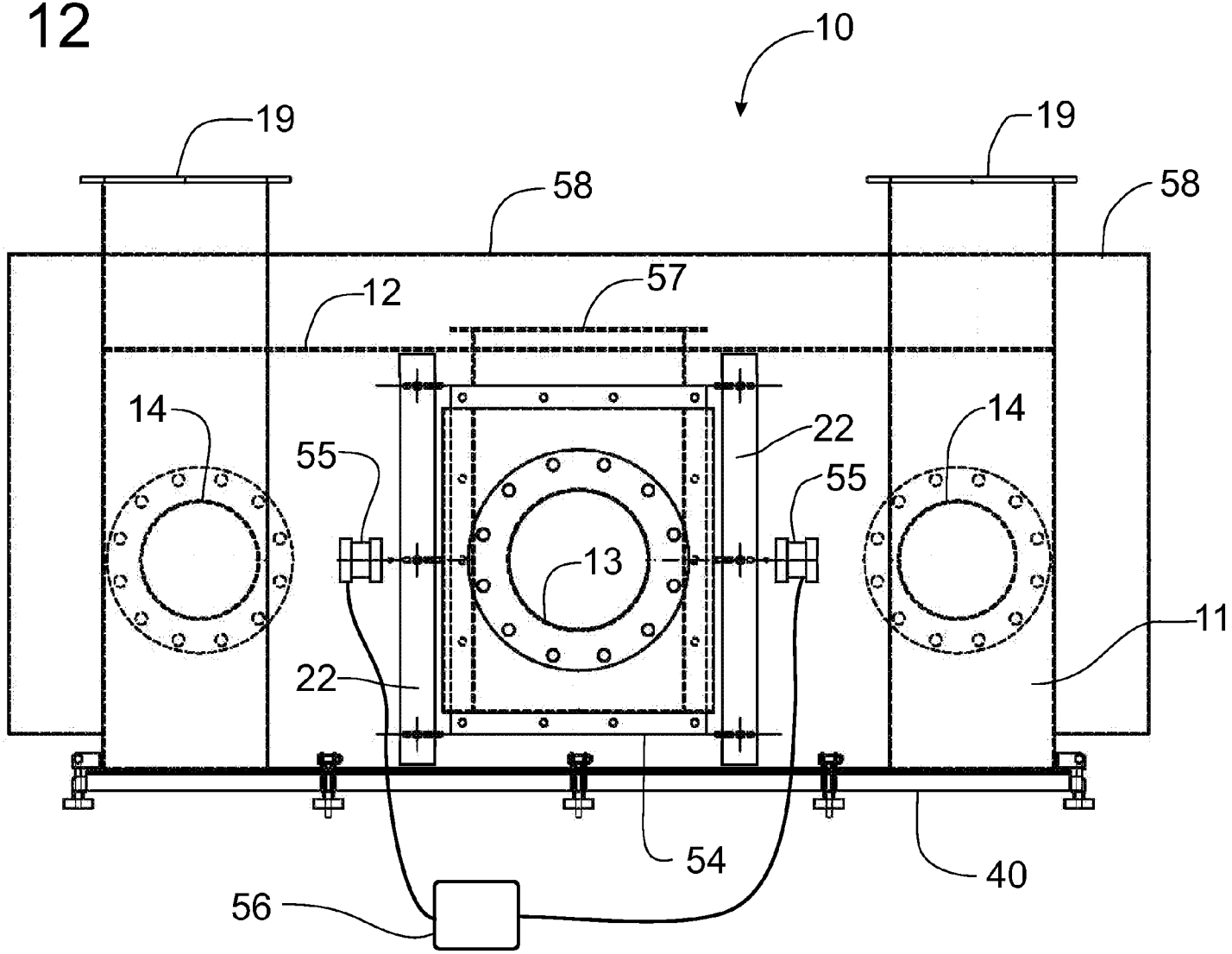
FIG. 12 is a top plan view of the dedusting apparatus depicted in FIG. 11.
Figure 13:
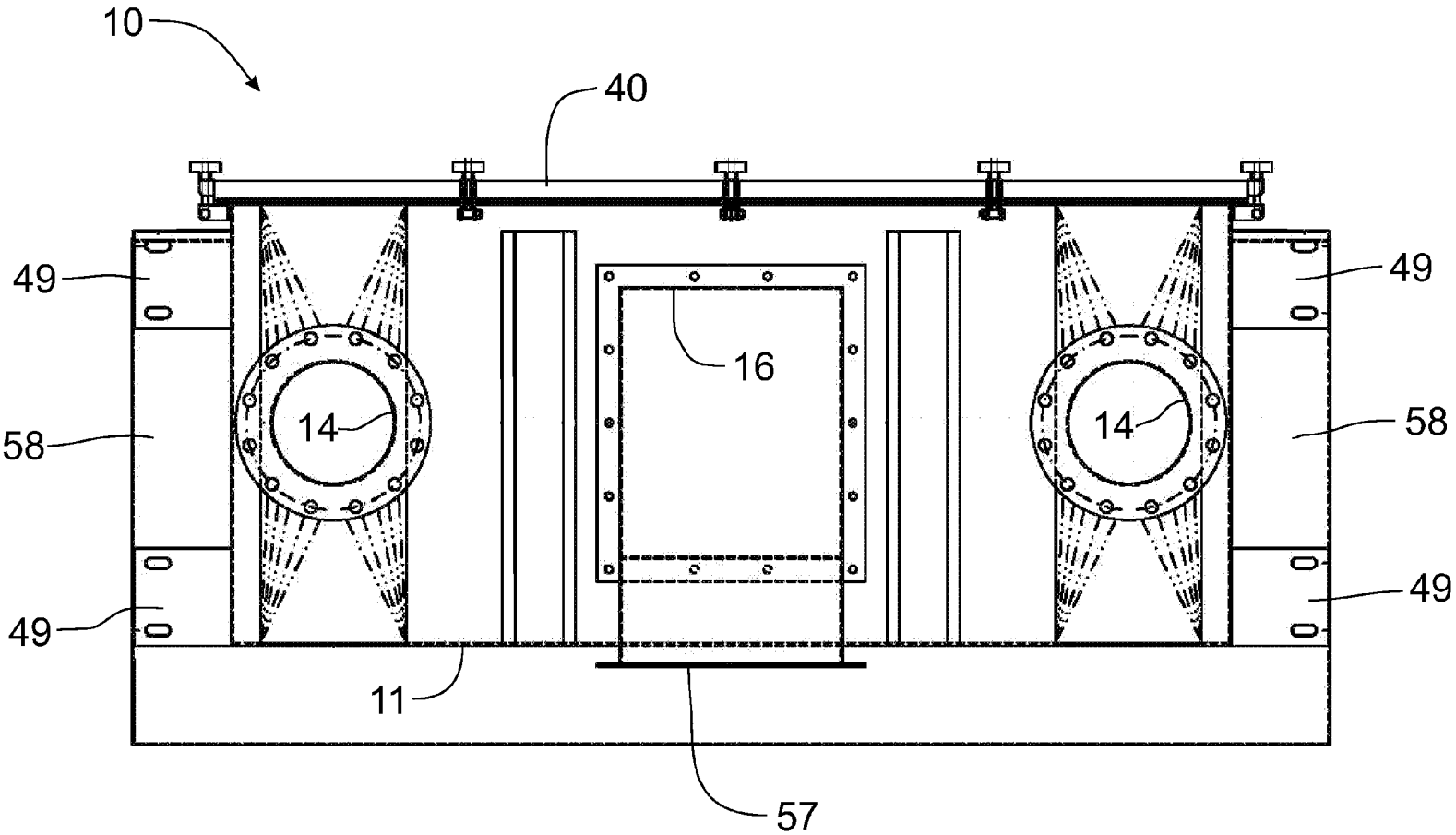
FIG. 13 is a bottom plan view of the dedusting apparatus depicted in FIG. 11.
Figure 14:
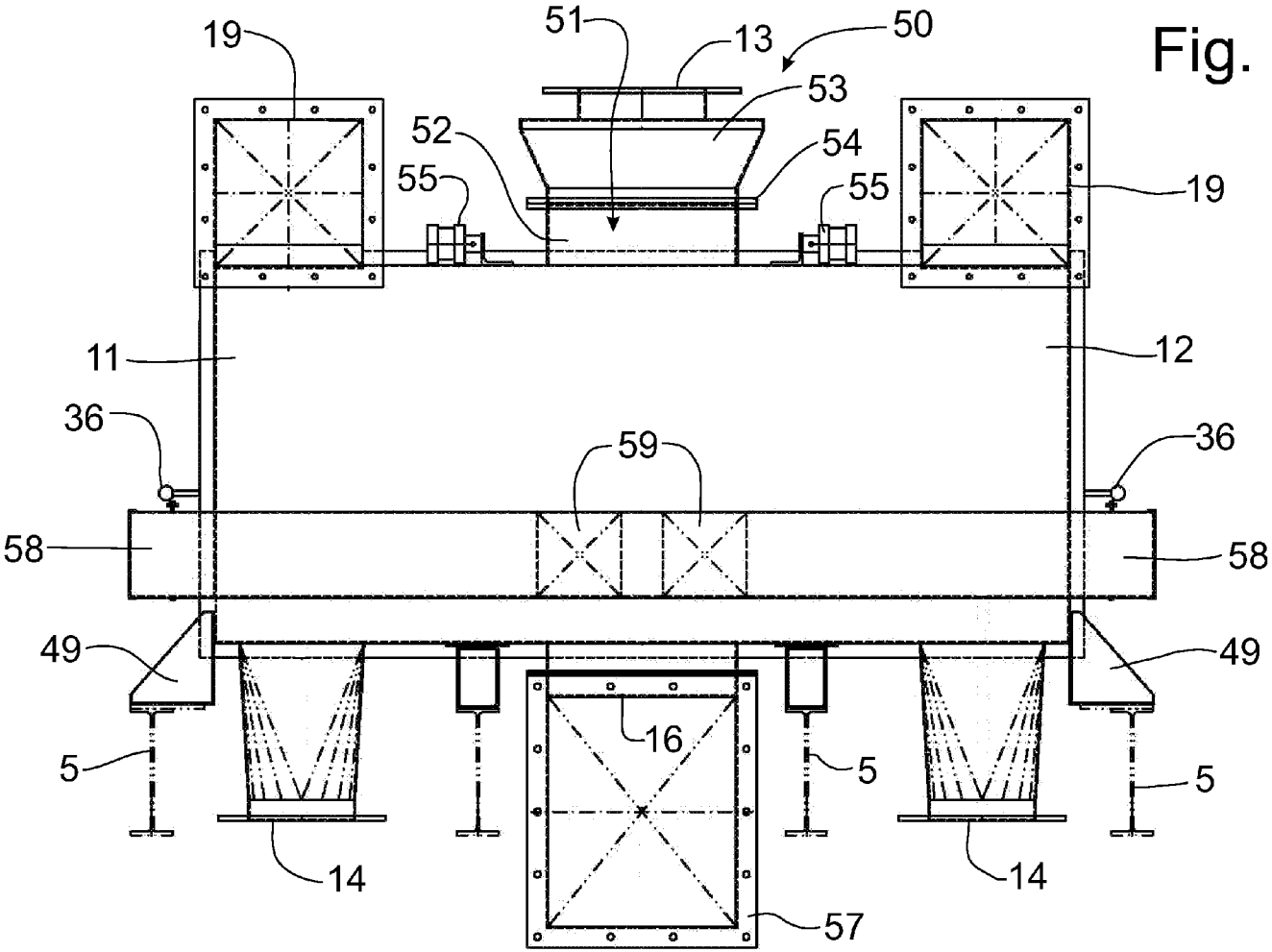
FIG. 14 is a rear elevational view of the dedusting apparatus incorporating the principles of the instant invention.
Figure 15:
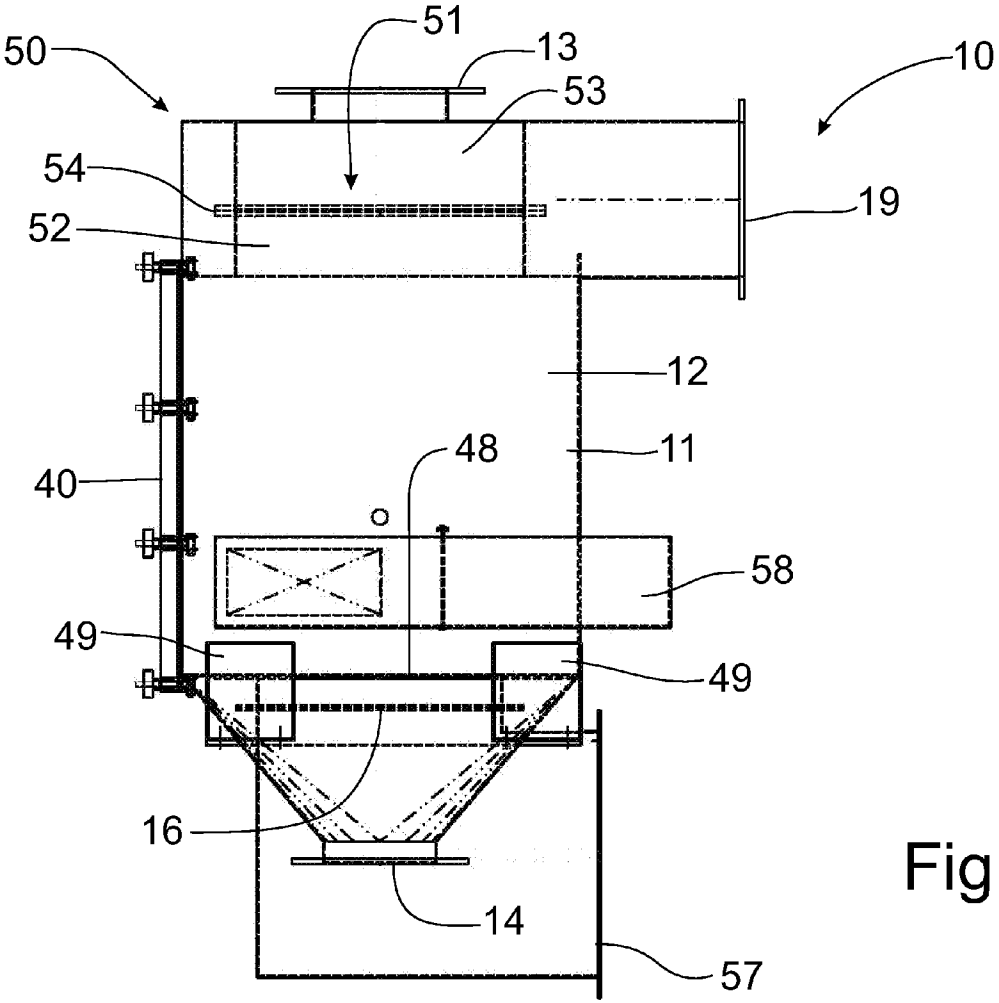
FIG. 15 is a side elevational view of the dedusting apparatus shown in FIG. 11.

The product particulates falling off of the lower end 21 of the respective wash decks 20 drop generally vertically toward the corresponding cleaned product outlet port 14 into a Venturi zone 30 through which air is blown upwardly through the falling product particulates to provide a vigorous finally cleaning. Air is directed into the Venturi zone 30 from beneath the wash deck 20 through louvers 29 in the support leg 28, best seen in FIG. 8. Clean air can also be directed into the Venturi zones 30 through the bypass ducts 45. As is best seen in FIG. 10, the main housing 11 is formed with a transverse, vertical central wall 17 on which the wash decks 20 are mounted. The clean air plenum or manifold 18 between the rear wall 12 and the central wall 17 is in flow communication with the clean air inlet opening 16*a* in the central wall 17 to direct a flow of air into the wash decks 20.

The clean air plenum 18 is also in flow communication with the bypass ducts 45 which direct a flow of air forwardly around the main housing 11 and back into the main housing 11 in front of the central wall 17 to be directed behind and under the pivoted members 35 into the Venturi zones 30. The amount of air moving through the bypass ducts 45 is controlled by dampers 46 pivotally mounted in the bypass ducts 45. The size of the Venturi zones 30 and the amount of air flow directed into the Venturi zones 30 is controlled by a pivoted member 35 operatively connected to a position adjustment lever 36 projecting outside of the main housing 11. The movement of the pivoted member 35 is depicted in phantom in FIG. 2.

The flow of air into the Venturi zone 30 from beneath the pivoted member 35 and through the louvers 29 presents a substantial cleaning action to the product particulates falling through the Venturi zone 30, but not so vigorous as to lift the product particulates to the dirty air exhaust port 19. If too much air is moving through the Venturi zone 30, the pivoted member 35 should be retracted to both increase the effective dimensions of the Venturi zone 30 and to decrease the amount of air moving into the Venturi zone. If the front wall 40 of the housing 11 were constructed of a transparent or semi-transparent polycarbonate, as is depicted in the drawings, the operation of the wash deck assembly could be physically viewed by looking through the front wall 40 to see if product particulates were being carried over into the dirty air exhaust port 19.

Figure 2:
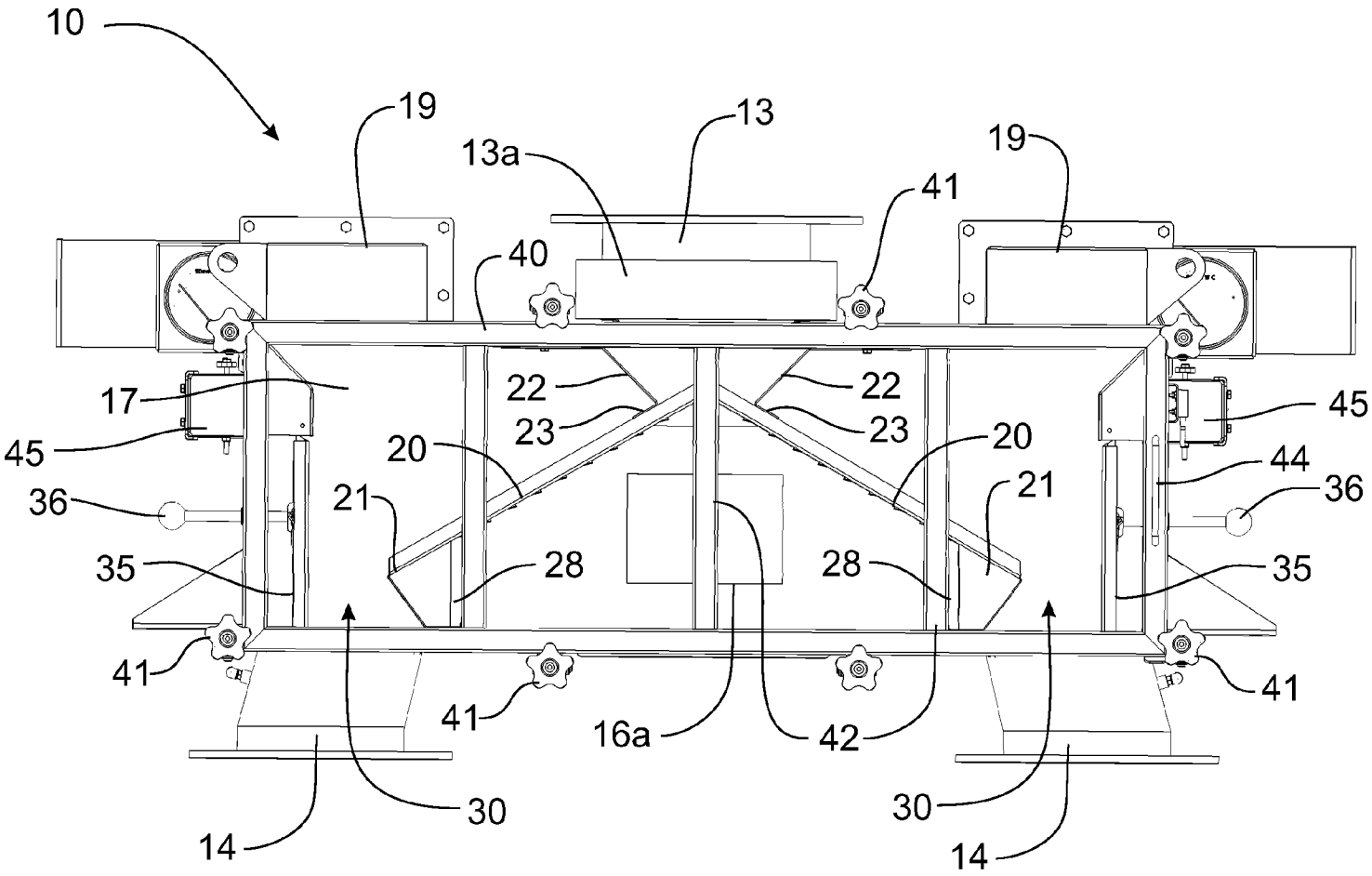
FIG. 2 is a schematic front elevational view of the dedusting apparatus shown in FIG. 1, the movement of the Venturi deflector members to control the air flow thought the Venturi zones being shown in phantom.
Figure 3:
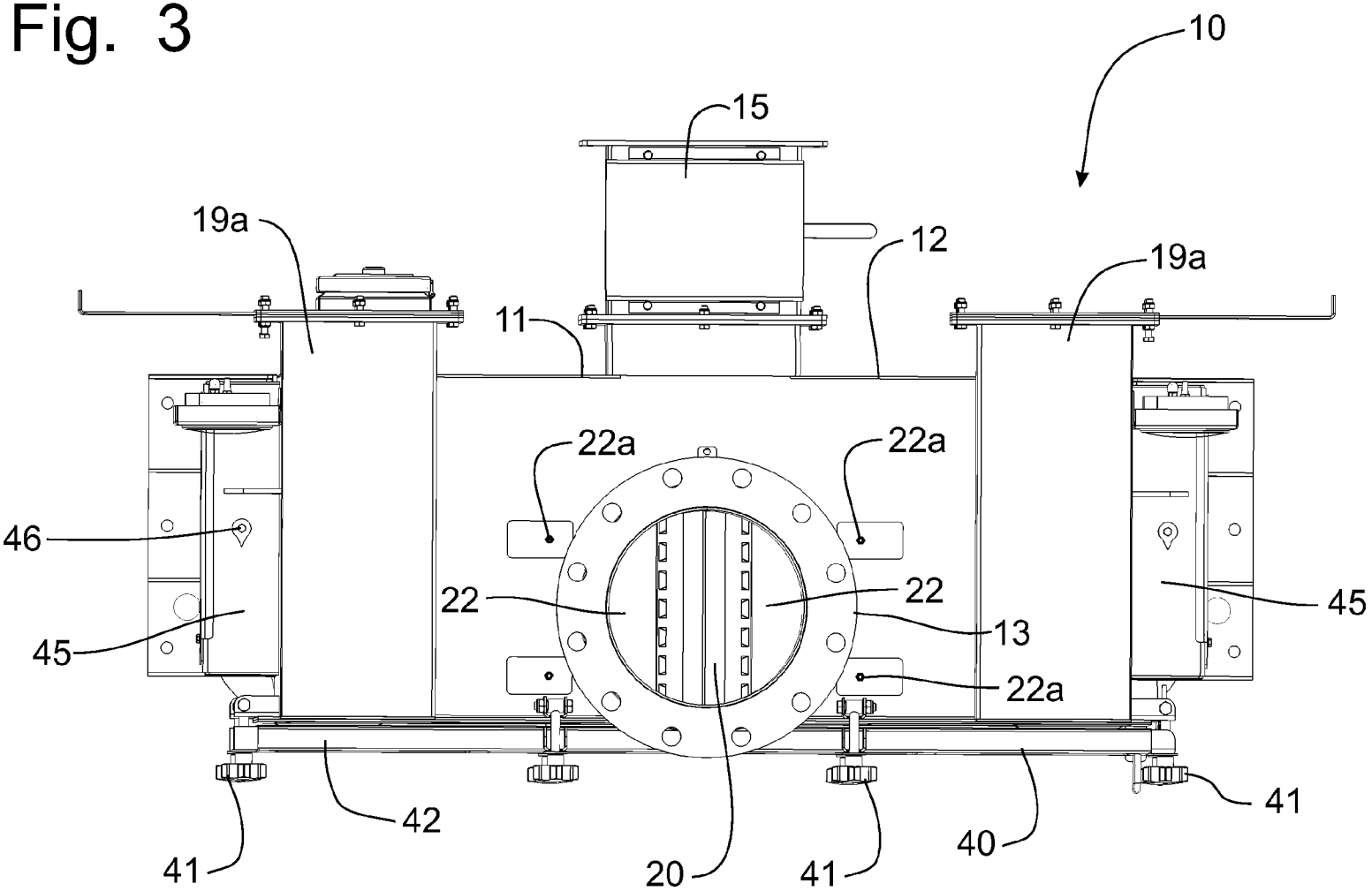
FIG. 3 is a top plan view of the dedusting apparatus shown in FIG. 1.
Figure 4:
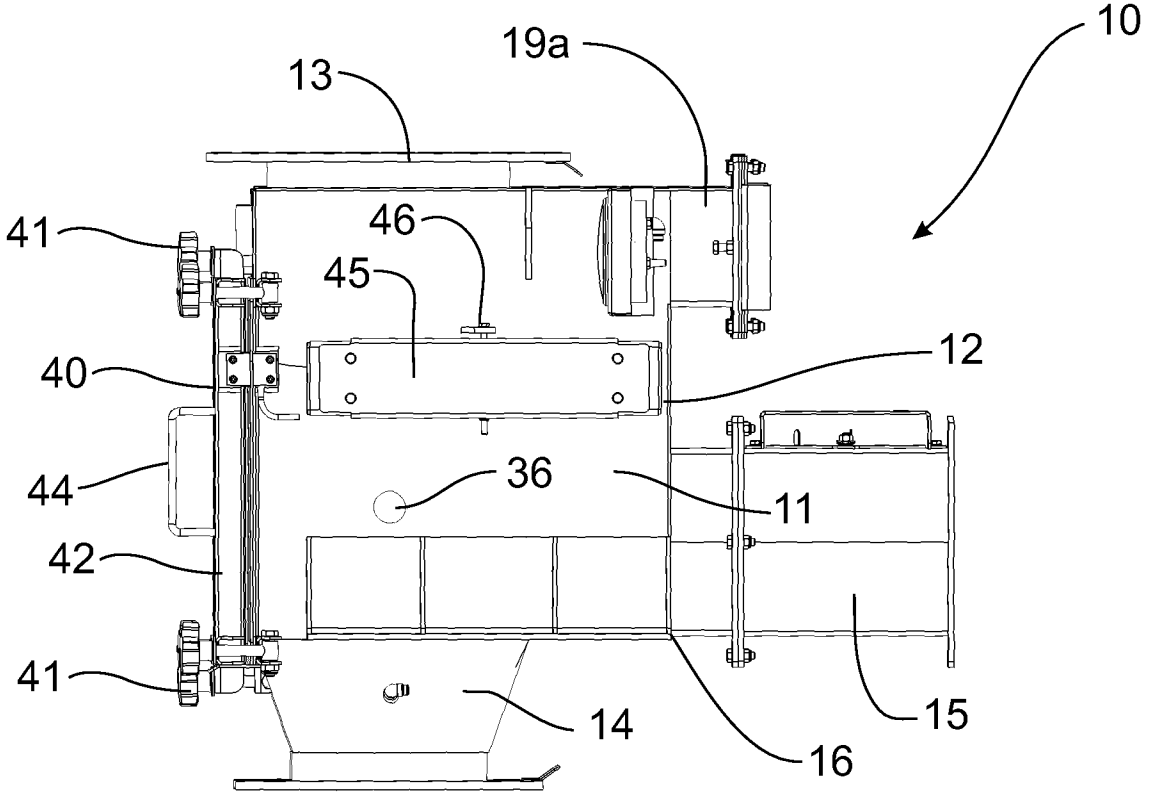
FIG. 4 is a end elevational view of the dedusting apparatus shown in FIG. 1.
Figure 5:
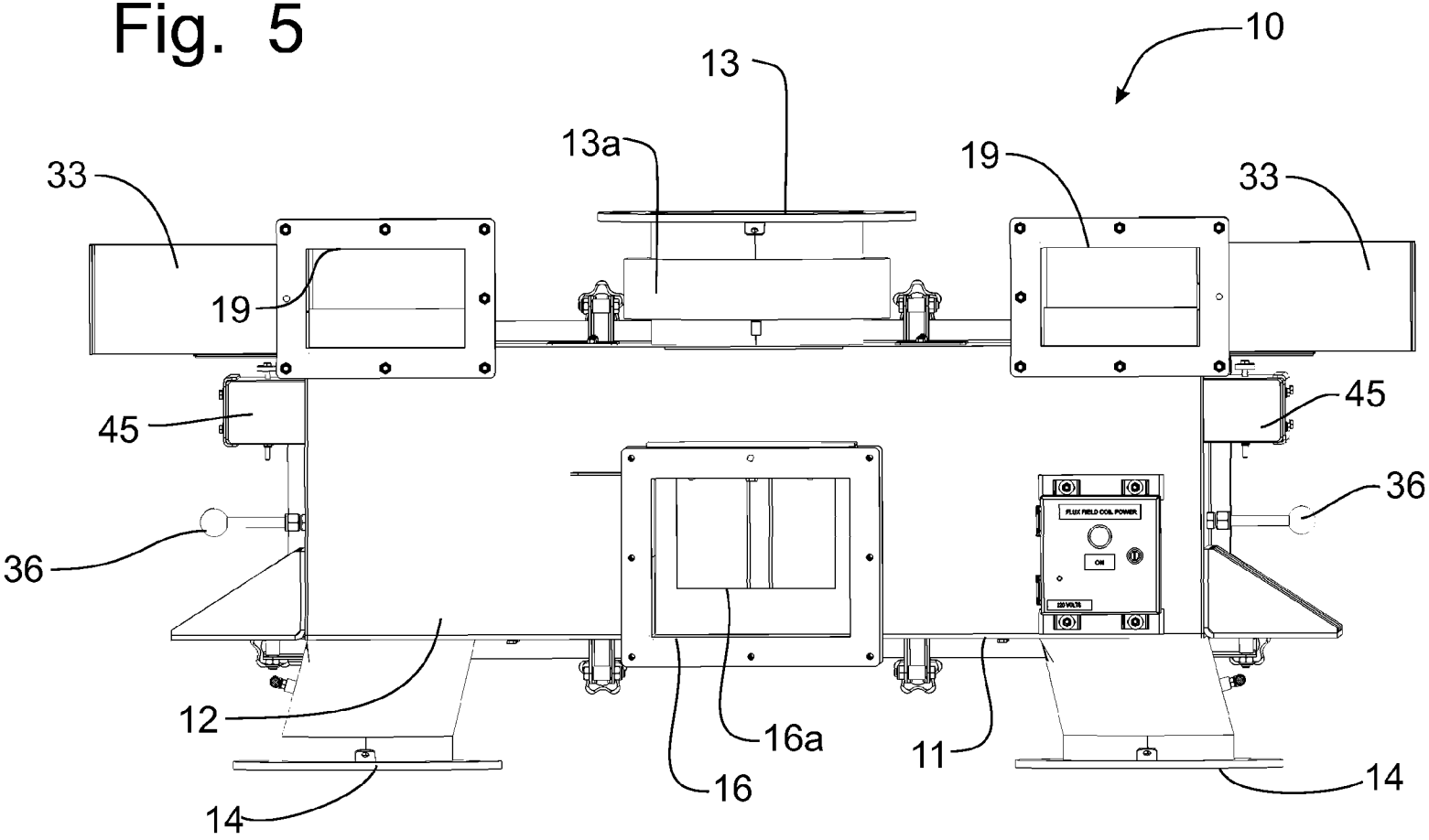
FIG. 5 is a rear elevational view of the dedusting apparatus shown in FIG. 1.
Figure 6:
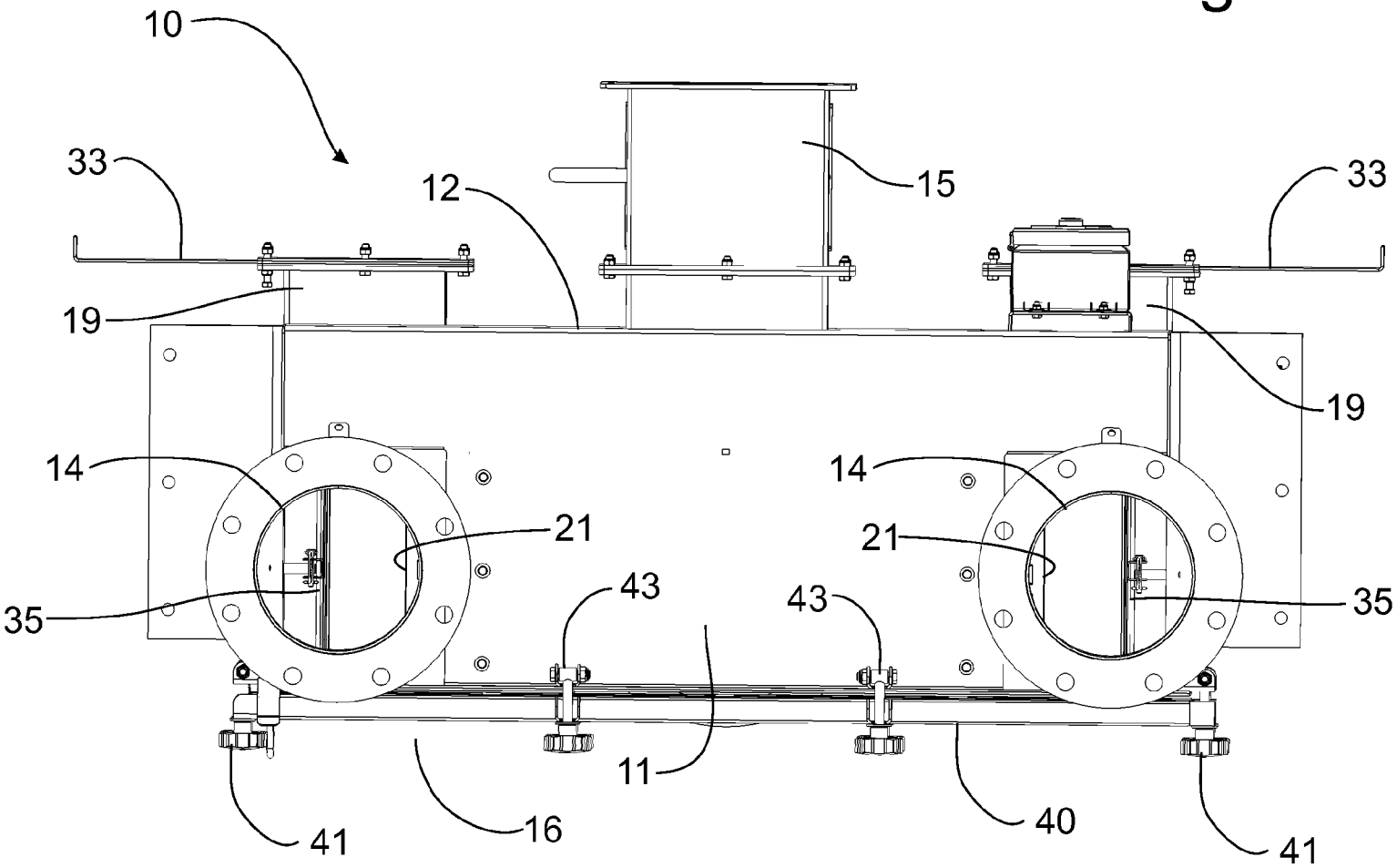
FIG. 6 is a bottom plan view of the dedusting apparatus shown in FIG. 1.
Figure 7:
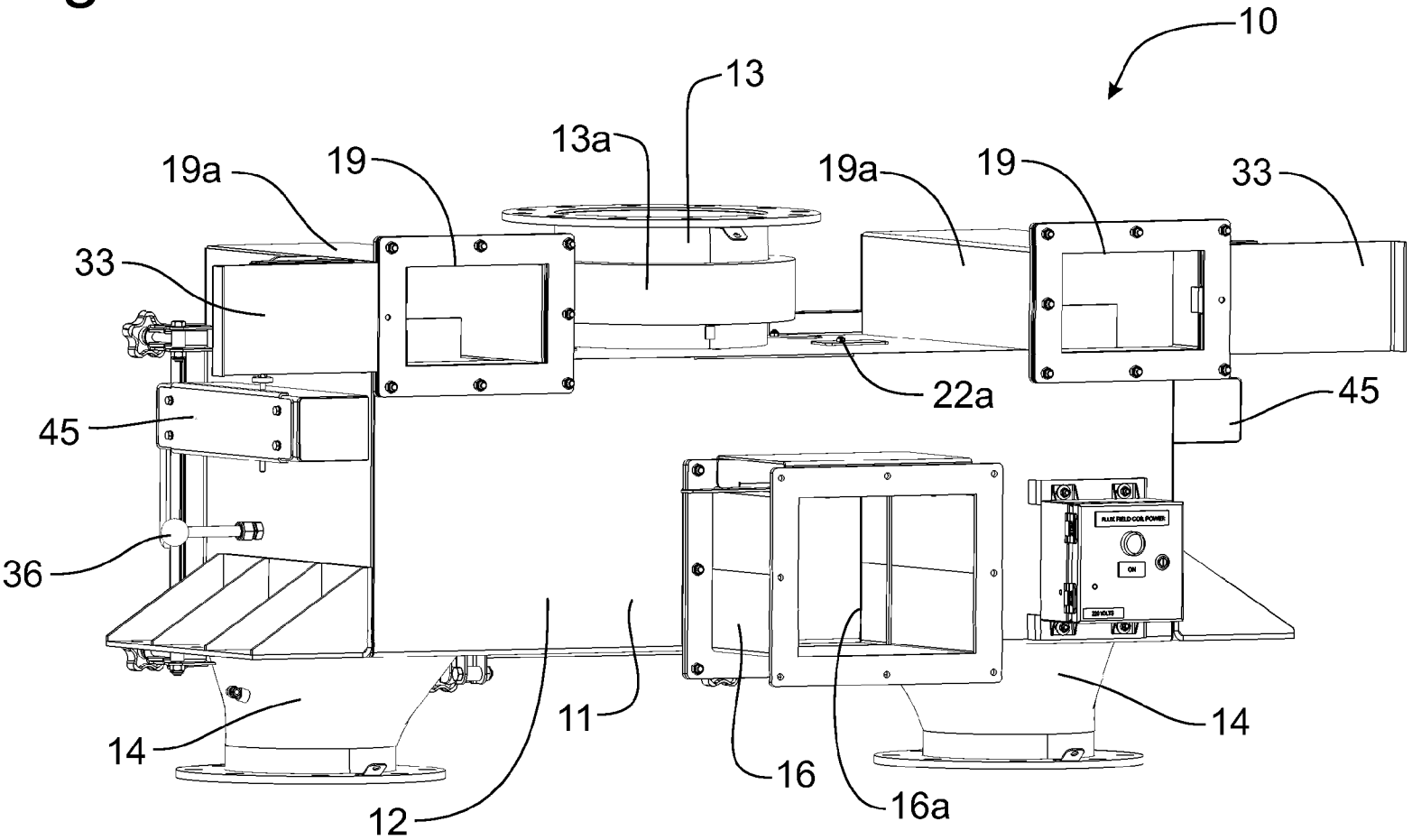
FIG. 7 is a rear perspective view of the dedusting apparatus shown in FIG. 1.
Figure 8:
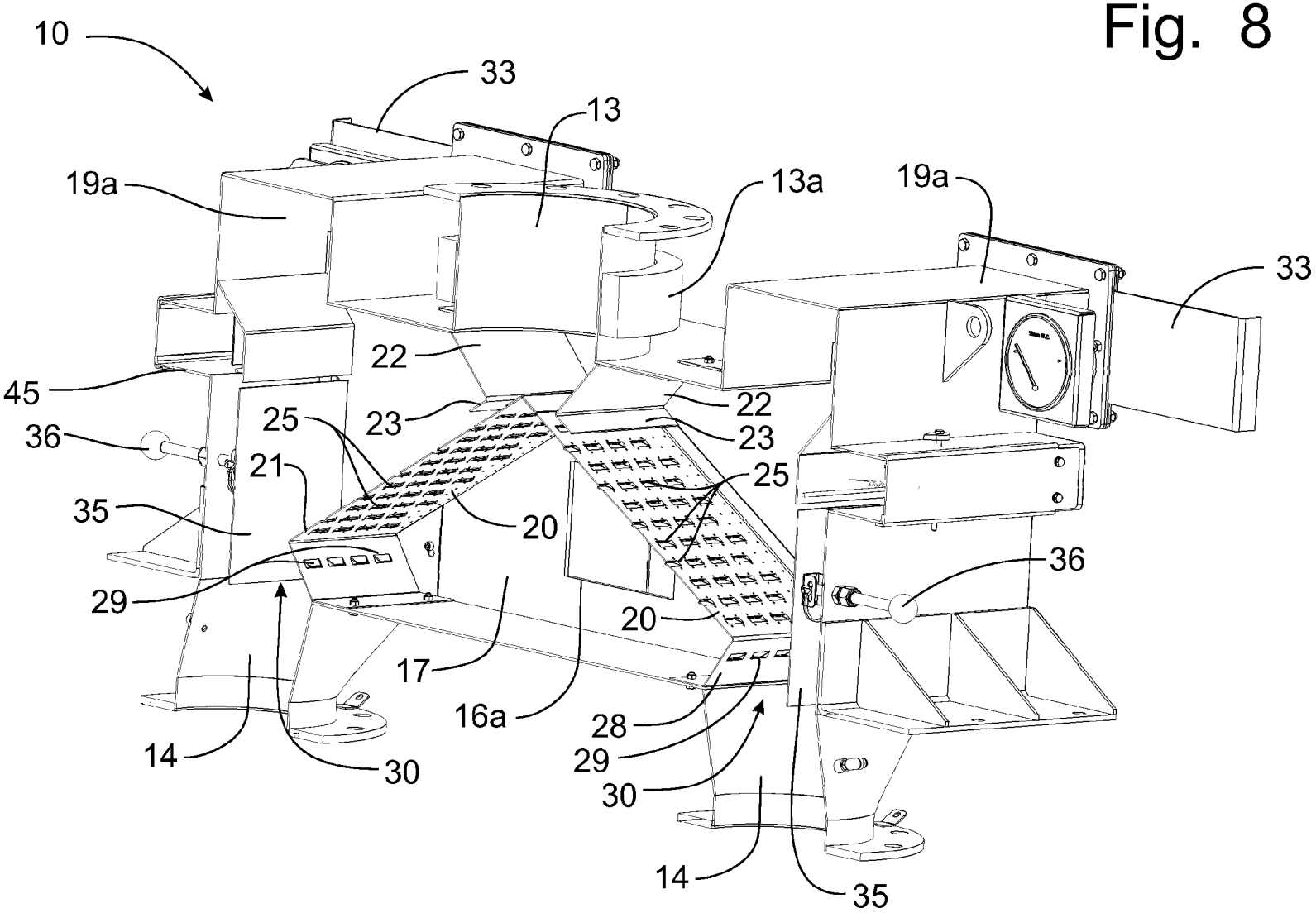
FIG. 8 is a perspective cross-sectional view of the dedusting apparatus taken along lines 8-8 of FIG. 4.
Figure 9:
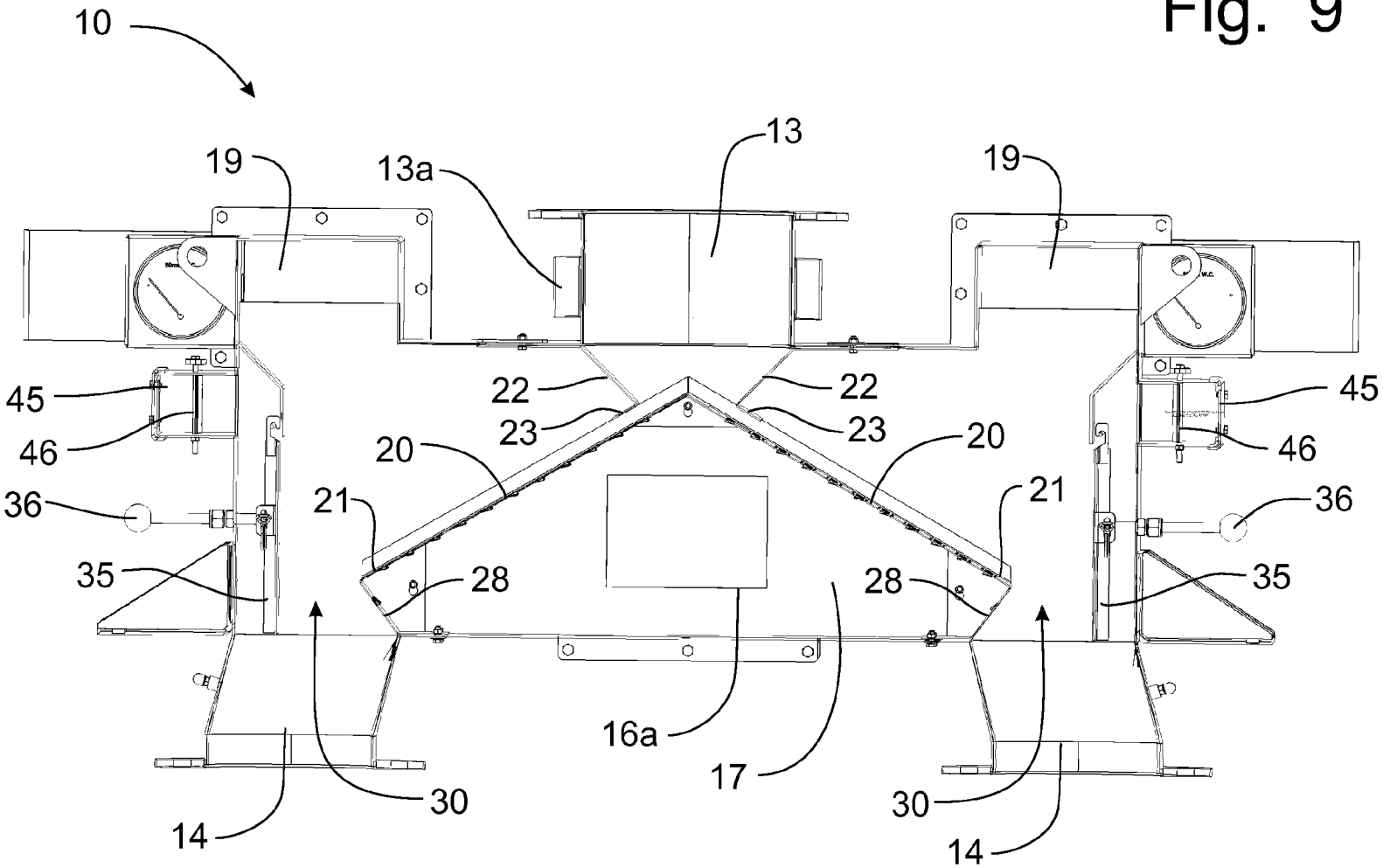
FIG. 9 is a front cross-sectional view of the dedusting apparatus corresponding to the section depicted in FIG. 8.

The support member 28 extending downwardly from the discharge edge 21 of the wash deck 20 is angled inwardly, as best seen in FIGS. 2 and 9, from the discharge edge 21 of the wash deck to engagement thereof with the housing 11. This angled configuration of the support member 28 directs the air outwardly from the louvers 29 into the Venturi zone 30 through which the particulate material falls from the discharge edge 21 of the wash deck 20. Thus, the direction of air flow from the louvers 29 passes at an angle to the vertical movement of the particulate material falling off of the wash decks 20 to provide an enhanced cleaning operation in the Venturi zone 30 which would have its narrowest horizontal dimension at the discharge edge 21.

The air flow in which the dust and debris contaminates are entrained is discharged from the housing 11 through the dirty air exhaust port 19 located at the top of the housing 11 above the Venturi zone 30 and on opposite sides of the product inlet port 13. Slidable plates 33 are mounted on the dirty air discharge passageway 19*a* to be positionally adjustable by sliding the respective plates 33 into or out of the dirty air discharge passageway 19*a*, which thus defines the throat opening of the dirty air exhaust passageway 19*a*.

The transparent front wall 40 of the housing 11 is removable from the housing 11 by releasing fasteners 41 from the frame supports 43 connecting the frame 42 of the front wall 40 to the housing 11. Alternatively, the front wall 40 can be formed as a hinged door with a handle 44 to facilitate movement of the front door 40 when released from the frame 42. With the removal of the front wall 40, the interior components, including the wash deck 20, the inlet deflector 22, and the pivoted member 35, can be removed from the housing 11 to facilitate cleaning of the interior of the housing 11 and the removed components 20, 22, 35.

The slope of the wash deck 20 is calculated to optimize product flow and air wash of the product particulates passing over the top surface 24 of the wash deck 20. The transversely spaced dual product outlet ports 14 are aligned with the ends of the corresponding wash decks 20 so that the cleaned particulate material can be packaged in two different manners. For example, separate collection bags (not shown) could be associated with each of the product outlet ports 14, or used to supply two different production lines. The oppositely positioned product outlet ports 14 provide substantial flexibility in use.

In operation, the dedusting apparatus 10 is installed at an appropriate location in conjunction with the desired utilization of the product outlet ports 14, and connected to a supply of particulate material through the product inlet port 13. The product particulates pass through the product inlet port 13 and are oriented into a laminar flow over the oppositely oriented sloped wash decks 20 by inlet deflectors 22, which are positionally adjustable relative to the wash deck 20 to define a desired product flow thickness over the wash deck 20.

Clean air is received through a clean air inlet opening 16*a* and directed into the housing 11 beneath the wash decks 20 and a flow that passes through louvers 29 in the support legs 28 for the wash decks 20 to the Venturi zones 30. The air flowing into the housing 11 beneath the wash decks 20 passes through slots 25 and openings formed in the wash decks 20. The air passing through the slots 25 and openings in the wash decks 20 create turbulence in the product particulates moving along the top surface 24 of the respective wash decks 20. Turbulence is enhanced by the upwardly projecting deflectors and the orientation of the horizontal slots 25 which accelerates the flow of the product particulates over the wash deck 20 and further creates turbulence. This movement of air through the wash decks 20 and through the flowing product particulates removes dust and debris contaminates from the product particulates, the static attraction forces having been neutralized by the magnetic flux field induced at the product inlet port 13 by the magnetic flux generator 13*a*.

The cleaned product particulates are discharged off the lower end 21 of the wash decks 20 into corresponding Venturi zones 30 having an upwardly moving air flow coming from the louvers 29 in the wash deck support leg 28 and from the bypass ducts 45 which flows behind and then under the Venturi deflector members 35 to enter the Venturi zones. This upwardly moving air flow provides a vigorous cleaning action to the product particulates falling through the Venturi zones 30 with the air flow therefrom combining with the air flow passing through the wash decks 20 to the dirty air exhaust port 19 at the top of the housing 11. The cleaned product particulates can fall through the respective product outlet ports 14 for packaging or for delivery to the manufacturing facility. The transparent front wall 40 of the housing 11 allows a visual inspection of the operation of the dedusting apparatus 10 to determine if adjustment to the inlet deflectors 22 or the Venturi deflector members 35, through manipulation of the control lever 36 to move the pivoted Venturi deflector members 35, is necessary. Furthermore, the removable front wall 40, allows convenient access to the interior of the housing 11 to facilitate cleaning of the housing 11 and all of the removable components therein.

Referring now to FIGS. 11-15, improvements to the dedusting apparatus 10 to improve operational efficiencies can best be seen. A dedusting apparatus 10 having a pair of opposing wash decks 20 works more effectively if the flow of particulate material through the product inlet port 13 is substantially equally divided between the two wash decks 20. This balanced flow of particulate material over the two wash decks 20 is true whether the housing 11 is formed with dual offset cleaned product outlet ports 14 or a single cleaned product outlet port 14. While the provision of adjustable inlet deflectors 22 and the central positioning of the apex between the two opposing wash decks 20 in the inlet port 13 can result in a balancing of the product flow distribution, the use of a round inlet opening 13 through which fluctuations of the material flow means that continuously balanced flow is unlikely.

To improve the balancing of product flow over the wash decks 20, the rectangular inlet structure 50 defines an inlet box 51 that extends to the upper portions of the wash decks 20, and is limited by the inlet deflectors 22 and the rectangular inlet structure 50. The depth of the inlet box 51 is substantially equal to the width of the wash decks 20 so as to define the inlet box between the front wall 40 and the rear wall 12 of the housing 11 and the inlet deflectors 22. That inlet box 51 extends vertically from the upper portions of the wash decks 20 into a rectangular inlet port 52 and into a transition member 53 that connects to the rectangular inlet port 52 via a rectangular flange 54 and terminates in a circular flange 13 that is connectable to the conventional inlet conduit that delivers particulate material from a supply, such as a silo (not shown), to a the dedusting apparatus 10.

One skilled in the art will recognize that the positioning of the inlet deflectors 22 regulates the flow of particulate material over the wash decks 20. The movement of the inlet deflectors 22 is preferably controlled through manipulation of the actuators 55 connected to the inlet deflectors 22. These actuators 55 can be powered electrically, by compressed air or by hydraulic fluid under pressure, and, as such, can be remotely controlled through the operation of an integrated electronic control system 56 which can be located at a remote location. Thus, the deflector mechanism 22 can be remote controlled through operation of an integrated overall electronic control system 56. The inlet deflectors 22 are operable independently and can be utilized to selectively shut down one side of the dedusting apparatus 10 by closing off the flow of particulate material to a selected one of the wash decks 20, or alternatively can be utilized to shut down the flow of particulate material on both wash decks 20 simultaneously. Due to this ability to control the inlet deflectors 22, no other control or shut off valve, such as a rotary valve, above the dedusting apparatus 10 is necessary.

In operation, the inlet deflectors 22 are moved into engagement with the upper portions of the respective wash decks 20 through manipulation of the adjustment actuators 55 to close off the flow of material from the inlet box 51 across the wash decks 20. The continuous infeed of particulate material through the inlet 13 will then accumulate until the inlet box 51 is filled with the particulate material and the accumulated material extends vertically into the rectangular inlet port 52. Then, the actuators 55 are again activated to cause movement of the inlet deflectors 22 in a manner to provide a separation between the terminal end of the inlet deflectors 22 and the adjacent wash deck 20, thus allowing the flow of particulate material past the inlet deflectors 22 and down the upper surface 24 of the wash decks 20 to be cleaned as described in greater detail above.

The movement of the inlet deflectors 22 is preferably parallel to the top of the main housing 11. As the inlet deflectors are moved away from the rectangular inlet port 52, the distance between the terminal end of the inlet deflector 22 and the top surface of the corresponding wash deck 20 increases, thus allowing more flow of particulate material over the top surface of the wash decks 20. Alternatively, the actuators 55 could be oriented in a manner that movement in the inlet deflectors 22 is substantially perpendicular to the top surface of the wash decks 20, which would also establish an controllable distance between the terminal end of the inlet deflector 22 and the top surface of the wash decks 20 for the flow of particulate material past the inlet deflectors 22.

So long as the inlet box 51 remains filled with particulate material and so long as the distance between the terminal ends of the inlet deflectors 22 and the corresponding upper portion of the wash decks 20 remains equal, the flow of the particulate material past the inlet deflectors 22 down the top surface 24 of the wash decks 20 will remain balanced and the resultant flow of cleaned material being discharged off of the lower discharge ends of the wash decks 20 will remain substantially equal. For configurations of the dedusting apparatus 10 that have dual offset discharge ports 14, the flow through the discharge ports 14 will be substantially equal.

The housing 11 can be streamlined to remove the clean air plenum 18 by relocating the clean air inlet port 16 from the rear wall of the housing 12 to a central portion of the floor 48 of the housing 11. Generally, the source of clean air is delivered to the dedusting apparatus 10 through a horizontal conduit (not shown), so the dedusting apparatus 10 would need a 90 degree transition member 57 that is coupled to the clean air inlet port 16. Thus, clean air is delivered into the housing 11 through the floor 48 beneath the wash decks 20. The clean air is forced through the slots 25, as described in greater detail above, to remove dirt and debris from the flow of particulate material passing over the top surface 24 of the wash decks 20. As is also described above, clean air is also directed through the louvers 29 in the supports 28 for the wash decks 20 to provide a Venturi zone 30 between the discharge end of the wash decks 20 and the corresponding side wall of the housing 11.

To supplement the flow of clean air into the Venturi zones 30, the housing 11 is formed with supplemental air conduits 58 that are in flow communication with the interior of the housing 11 through supplemental air inlet openings 59 in the rear wall 12. The supplemental air conduits 58 wrap around the housing 11 and terminate at the Venturi zones 30 to deliver a source of supplemental air into the Venturi zones on the opposite side thereof from the air coming through the louvers 29. As is described above, the Venturi zone 30 is provided with a pivoted member 35 and a position adjustment lever 36 to control selectively the flow of supplemental air into the Venturi zone 30 from the conduit 58.

The dedusting apparatus 10 depicted in FIGS. 11-16 is particularly adapted to supply cleaned particulate material into railroad cars 60 and other bulk carriers. The housing 11 is supported on I-beams 5, the outer two of which can be bolted to mounting brackets 49 to secure the dedusting apparatus 10 to the I-beam supports 5 at a location proximate to a railroad car loading station and a silo 61 containing a supply of particulate material to be cleaned by the dedusting apparatus 10 and then conveyed into the railroad car 60. In such an environment, the balanced loading of the wash decks 20 to provide an equal distribution of the cleaned particulate material into the railroad car 60 or a truck (not shown) is highly important. If one side of the railroad car 60 is loaded with cleaned material more quickly than the other side, the bulk loading process becomes inefficient as parts of the railroad car 60 will not be fully loaded.

Figure 16:
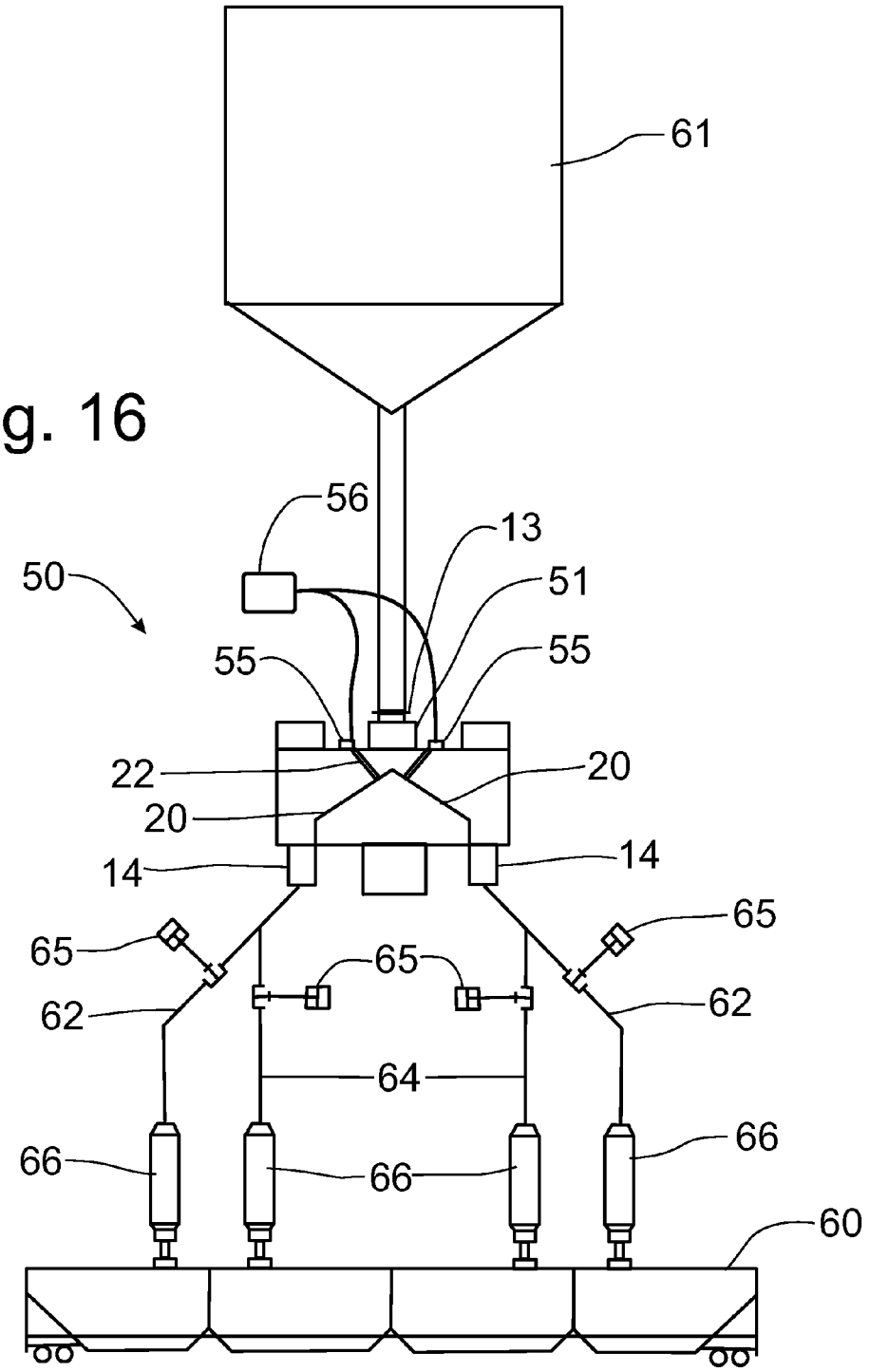
FIG. 16 is a schematic diagram depicting the process for cleaning and loading particulate material into railroad cars.

Referring now to FIG. 16, the bulk loading process for a railroad car 60 is schematically depicted. The silo 61 provides a continuous supply of particulate material into the inlet port 13 of the dedusting apparatus 10. The flow of particulate material is equally balanced between the wash decks 20, as is described above, to provide an equal discharge of cleaned particulate material through the discharge ports 14. Typically, the cleaned particulate material is fed first into the outer feed lines 62 to partially fill the outer compartments for balancing the loading in the railroad car 60. The air exhaust sleeves 66 extract the air from the railroad car compartment as the particulate material fills the compartment. The shutoff valves 65 for the inner lines 64 are then opened to provide four compartment feeding.

When a compartment is filled, the corresponding shutoff valve 65 is closed to direct all remaining flow into the adjacent compartment until both compartments are filled. In the event one end of the railroad car 60 is not yet completely filled, the actuator 55 corresponding to the inlet deflector 22 for that side of the railroad car 60 can be closed against the wash deck 20 to allow product flow to the unfilled side of the railroad car 60 until the railroad car 60 is completely filled. Accordingly, one skilled in the art will recognize that an even flow of particulate material through the opposing discharge ports 14 is preferable in order that one end of the railroad car is not filled before the opposing end is filled.

However, when one end of the railroad car 60 (or other bulk carrier) is not completely filled, the inlet deflector 22 for the opposing wash deck 20 can be moved into engagement with the opposing wash deck 20 to cease the flow of particulate material over the opposing wash deck 20 so that only the wash deck 20 corresponding to the unfilled end of the railroad car 60 has product flow over the upper surface thereof to continue the filling of the unfilled end of the railroad car 60. Once both the railroad car 60 is completely filled, both inlet deflectors 22 will be closed against the corresponding wash decks 20 to allow the inlet box 51 to fill with particulate material while the next railroad car 60 is positioned for filling.

It will be understood that changes in the details, materials, steps and arrangements of parts, which have been described and illustrated to explain the nature of the invention will occur to and may be made by those skilled in the art upon a reading of this disclosure within the principles of the scope of the invention. The foregoing description illustrates the preferred embodiment of the invention; however, concepts, as based upon the description may be employed in other embodiments without departing from the scope of the invention. Accordingly, the following claims are intended to protect the invention broadly, as well as in the specific form shown.

Having thus described the invention, what is claimed is:

1. A particulate material dedusting apparatus for cleaning unwanted debris from the particulate material, comprising:

a housing;

a central infeed opening directing a flow of contaminated particulate material into the housing;

a pair of primary wash decks joined at an apex and extending downwardly and outwardly therefrom to opposing discharge edges;

a rectangular inlet structure connected to said central infeed opening to receive contaminated particulate material therefrom, said rectangular inlet structure including an inlet deflector corresponding to each respective primary wash deck and being movable relative to said wash deck between a closed position engaged against said primary wash deck and an opened position defining a gap between said inlet deflector and the corresponding said wash deck to permit a flow of contaminated particulate material therebetween;

a clean air inlet port to direct a flow of clean air underneath said primary wash decks to pass air through said primary wash decks to create cleaned particulate material discharged from said discharge edges;

a Venturi zone located outboard of each respective discharge edge; and a cleaned product discharge port supported by said housing for the discharge of cleaned particulate material from the housing.

2. The apparatus of claim 1 wherein said rectangular inlet structure is filled with said contaminated particulate material before said inlet deflectors are moved from said closed position to said opened position.

3. The apparatus of claim 2 wherein said filled rectangular inlet structure provides a balanced flow to said opposing primary wash decks.

4. The apparatus of claim 3 wherein each said wash deck includes a lower area below said upper area, said lower area terminating in said discharge edge located above the corresponding said discharge port, each said wash deck further including a support leg including openings therethrough for the passage of air upwardly into the corresponding said Venturi zone.

5. The apparatus of claim 4 wherein said clean air inlet port is located in a floor member of said housing to blow air upwardly into an underside of said wash decks.

6. The apparatus of claim 5 wherein each said Venturi zone is supplied with air from a supplemental air conduit that is in flow communication with a rear wall of said housing to permit the passage of air from said clean air inlet port into said supplemental air conduits.

7. The apparatus of claim 3 wherein said housing is provided with a pair of opposing cleaned product discharge ports located, respectively, at the discharge edges of said primary wash decks to receive the cleaned particulate material therefrom, said filled rectangular inlet structure providing a balanced discharge of cleaned particulate material from the opposing cleaned product discharge ports.

8. The apparatus of claim 7 wherein said inlet deflectors are movable between said closed and opened positions by manipulating respective actuators operable connected to said inlet deflectors.

9. The apparatus of claim 8 wherein said rectangular inlet structure further includes a rectangular inlet port extending upwardly from said housing and a rectangular transition member connected to said rectangular inlet port to connect to a non-rectangular said central infeed opening.

10. A dedusting apparatus for removing dust and debris from a flow of particulate material, comprising:

a housing connected to a central product inlet opening to provide a flow of contaminated particulate material into said housing;

a pair of opposing wash decks defining a pair of oppositely directed, downwardly sloped upper surfaces terminating at respective discharge ends and being positioned to receive particulate material from said product inlet opening to flow along said upper surfaces, each said wash deck being formed with openings therethrough to allow a passage of air through said wash deck into the flow of particulate material over the upper surface of said wash deck;

an inlet deflector corresponding to each of said wash decks, each inlet deflector being positionably movable independently of the other inlet deflector to control the flow of particulate material over the upper surface of each corresponding wash deck, each said inlet deflector being movable between a closed position engaged with the corresponding wash deck to stop the flow of particulate material past the inlet deflector and onto the wash deck, and an open position defining a gap between a distal end of the inlet deflector and the upper surface of the corresponding wash deck to allow the flow of particulate material over the corresponding wash deck; and a pair of product outlet openings aligned with a discharge end of each said wash deck to receive cleaned particulate material therefrom; each said product outlet opening being laterally offset on opposing sides of said central product inlet opening such that said central product inlet opening and neither of said product outlet openings are vertically aligned.

11. The dedusting apparatus of claim 10 wherein said inlet deflectors are movable between said closed and opened positions by manipulating respective actuators operably connected to said inlet deflectors.

12. The dedusting apparatus of claim 11 wherein said actuators for said inlet deflectors are controlled remotely through an electronic control system.

13. The dedusting apparatus of claim 11 wherein said central product inlet opening comprises:

a rectangular inlet structure receiving contaminated particulate material, said rectangular inlet structure defining an inlet box having a width substantially equal to a corresponding width of said wash decks to provide a filled inlet box for a balanced distribution of particulate material over the respective wash decks.

14. The dedusting apparatus of claim 13 wherein said rectangular inlet structure further includes a rectangular inlet port extending upwardly from said housing and a rectangular transition member connected to said rectangular inlet port to connect to a non-rectangular said central infeed opening.

15. The dedusting apparatus of claim 11 wherein said clean air inlet port is located in a floor member of said housing to blow air upwardly into an underside of said wash decks.

16. The dedusting apparatus of claim 15 wherein a Venturi zone is located at the lower end of each respective said wash deck, said Venturi zones being supplied with air from a supplemental air conduit that is in flow communication with a rear wall of said housing to permit the passage of air from said clean air inlet port into said supplemental air conduits.

17. A particulate material dedusting apparatus for cleaning unwanted debris from the particulate material, comprising:

a housing;

a central product infeed opening directing a flow of contaminated particulate material into the housing;

a pair of primary wash decks joined at an apex and extending downwardly and outwardly therefrom to opposing discharge edges;

a clean air inlet port to direct a flow of clean air underneath said primary wash decks to pass air through said primary wash decks to create cleaned particulate material discharged from said discharge edges, said clean air inlet port being located in a floor member of said housing to blow air directly upwardly into an underside of said wash decks;

a Venturi zone located outboard of each respective discharge edge; and a cleaned product discharge port supported by said housing for the discharge of cleaned particulate material from the housing.

18. The dedusting apparatus of claim 17 wherein each said Venturi zone is supplied with air from a supplemental air conduit that is in flow communication with a rear wall of said housing to permit the passage of air from said clean air inlet port into said supplemental air conduits.

19. The dedusting apparatus of claim 18 further comprising:

a rectangular inlet structure connected to said central infeed opening to receive contaminated particulate material therefrom, said rectangular inlet structure including an inlet deflector corresponding to each respective primary wash deck and being movable relative to said wash deck between a closed position engaged against said primary wash deck and an opened position defining a gap between said inlet deflector and the corresponding said wash deck to permit a flow of contaminated particulate material therebetween.

20. The dedusting apparatus of claim 19 wherein said rectangular inlet structure is filled with said contaminated particulate material before said inlet deflectors are moved from said closed position to said opened position, said filled rectangular inlet structure providing a balanced flow to said opposing primary wash decks and a balanced discharge of cleaned particulate material through said product outlet openings, said inlet deflectors being movable between said closed and opened positions by manipulating respective actuators operable connected to said inlet deflectors.

21. The dedusting apparatus of claim 19 wherein each said inlet deflector is independently movable between said closed position and said opened position with respect to the other inlet deflector such that either of said inlet deflectors can be closed against the corresponding wash deck to stop the flow of particulate material while the opposing wash deck continues to receive particulate material for cleaning.

* * * * *